US011312161B2

(12) United States Patent
Mizutani et al.

(10) Patent No.: US 11,312,161 B2
(45) Date of Patent: Apr. 26, 2022

(54) CONTACTING MEMBER, DRYING DEVICE, AND PRINTING APPARATUS

(71) Applicant: RICOH COMPANY, LTD., Tokyo (JP)

(72) Inventors: Yuuki Mizutani, Kanagawa (JP); Tomohiro Tamai, Kanagawa (JP)

(73) Assignee: Ricoh Company, LTD., Tokyo (JP)

( * ) Notice: Subject to any disclaimer, the term of this patent is extended or adjusted under 35 U.S.C. 154(b) by 0 days.

(21) Appl. No.: 16/794,440

(22) Filed: Feb. 19, 2020

(65) Prior Publication Data

US 2020/0290372 A1 Sep. 17, 2020

(30) Foreign Application Priority Data

Mar. 14, 2019 (JP) ..... JP2019-046744

(51) Int. Cl.

| | |
|---|---|
| ***B41J 2/01*** | (2006.01) |
| ***B41J 13/076*** | (2006.01) |
| ***B41J 2/17*** | (2006.01) |
| ***B41J 11/00*** | (2006.01) |

(52) U.S. Cl.

CPC ..... *B41J 13/076* (2013.01); *B41J 2/17* (2013.01); *B41J 11/0015* (2013.01); *B41J 11/0024* (2021.01)

(58) Field of Classification Search

None

See application file for complete search history.

(56) References Cited

U.S. PATENT DOCUMENTS

| | | | | |
|---|---|---|---|---|
| 2005/0076798 | A1 | 4/2005 | Sato et al. | |
| 2008/0098916 | A1 | 5/2008 | Inoue | |
| 2013/0034720 | A1* | 2/2013 | Maniwa | G03G 15/2025 428/316.6 |
| 2013/0189007 | A1* | 7/2013 | Ohtsu | G03G 15/206 399/329 |

(Continued)

FOREIGN PATENT DOCUMENTS

| | | | |
|---|---|---|---|
| CN | 1488515 | A | 4/2004 |
| CN | 1772498 | A | 5/2006 |

(Continued)

OTHER PUBLICATIONS

Extended European Search Report dated Aug. 17, 2020 in corresponding European Patent Application No. 20156536.3 citing document AO therein, 6 pages.

(Continued)

*Primary Examiner* — Erica S Lin
*Assistant Examiner* — Tracey M McMillion
(74) *Attorney, Agent, or Firm* — Grüneberg and Myers PLLC

(57) ABSTRACT

A contacting member is provided that contacts a region of a contacted member to which a liquid composition has been applied. The contacting member has a fluororesin fiber layer containing a fluororesin fiber, which is disposed on a surface which contacts the contacted member. The fluororesin fiber layer has an average deformation amount of from 5.0 to 18.0 μm/N, which is calculated from a displacement amount obtained when a circular indenter having a diameter of 5 mm is pushed into the fluororesin fiber layer.

14 Claims, 2 Drawing Sheets

(56) References Cited

U.S. PATENT DOCUMENTS

| | | | | |
|---|---|---|---|---|
| 2015/0174924 | A1* | 6/2015 | Fuchioka | B41J 11/0015 347/102 |
| 2018/0244072 | A1* | 8/2018 | Tanaka | B41J 2/442 |
| 2018/0281498 | A1* | 10/2018 | Yamamoto | B41J 11/002 |
| 2019/0053634 | A1* | 2/2019 | Chirackal | D01F 6/46 |

FOREIGN PATENT DOCUMENTS

| | | | | |
|---|---|---|---|---|
| CN | 101168332 | A | 4/2008 | |
| JP | 8-123232 | | 5/1996 | |
| JP | 11347322 | A * | 12/1999 | |
| JP | 2009-037012 | | 2/2009 | |
| JP | 2010276748 | A * | 12/2010 | |
| JP | 2011-107729 | | 6/2011 | |
| JP | 2014-156317 | | 8/2014 | |
| JP | 2016095475 | A * | 5/2016 | G03G 15/2057 |
| JP | 2017-213846 | | 12/2017 | |
| WO | WO 2018/143976 | A1 | 8/2018 | |

OTHER PUBLICATIONS

Shigenori Kuga, et al., "Development and application of dynamic scanning absorptometer—Automation and improvement of Bristow measurement-", Japan Tappi Journal, vol. 48, 1994, No. 5, pp. 88-92.

Office Action dated Jun. 3, 2021 in Chinese Application No. CN202010155140.1.

* cited by examiner

CONTACTING MEMBER, DRYING DEVICE, AND PRINTING APPARATUS

CROSS-REFERENCE TO RELATED APPLICATIONS

This patent application is based on and claims priority pursuant to 35 U.S.C. § 119(a) to Japanese Patent Application No. 2019-046744, filed on Mar. 14, 2019, in the Japan Patent Office, the entire disclosure of which is hereby incorporated by reference herein.

BACKGROUND

Technical Field

The present disclosure relates to a contacting member, a drying device, and a printing apparatus.

Description of the Related Art

In a printing apparatus such as an inkjet device, a conveyer for conveying a printing material (e.g., cut paper) is provided. The conveyer conveys the printing material to a liquid composition applicator that applies a liquid composition (e.g., inkjet ink) thereto, or a liquid composition heater that heats the applied liquid composition to dry. There are various types of conveyers, and a plurality of rollers arranged at intervals along the axial direction is often used.

However, among such conveyers, those which come into direct contact with a region to which the liquid composition has been applied may cause an undesired phenomenon in which the liquid composition is transferred to the conveyer.

SUMMARY

In accordance with some embodiments of the present invention, a contacting member is provided that contacts a region of a contacted member to which a liquid composition has been applied. The contacting member has a fluororesin fiber layer containing a fluororesin fiber, which is disposed on a surface which contacts the contacted member. The fluororesin fiber layer has an average deformation amount of from 5.0 to 18.0 μm/N, which is calculated from a displacement amount obtained when a circular indenter having a diameter of 5 mm is pushed into the fluororesin fiber layer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
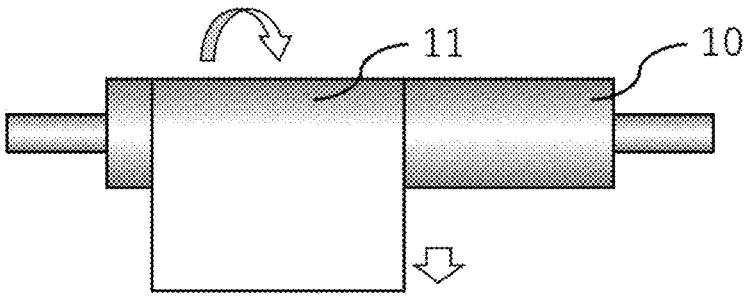
FIGS. 1A to 1C are schematic diagrams illustrating a situation in which a roller-shaped contacting member conveys a contacted member.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

A roller for feeding a printing material in a device having a printing function, which includes a rod-shaped core and a wire including an easily-lubricatable resin fiber that is spirally wound around an outer circumferential surface of the core, has been proposed in attempting to smoothly feed the printing material and maintain the print image quality high.

However, under the situation in which a contacting member having a fiber layer on its surface and a contacted member (e.g., recording medium) are in pressure contact with each other, when the contacted member is conveyed, a boundary is generated on the fiber layer between a region that has been in contact with the contacted member and another region that has not been in contact with the contacted member. If another contacted member to which the liquid composition has been applied is thereafter conveyed over the boundary, image detachment may occur.

A contacting member according to an embodiment of the present invention has a fiber layer on its surface and provides an excellent effect of preventing the occurrence of image detachment.

Hereinafter, embodiments of the present invention are described.

Contacting Member

The contacting member according to an embodiment of the present invention contacts a region of a contacted member to which a liquid composition has been applied. The contacting member has a fluororesin fiber layer on a surface which contacts the contacted member, and the fluororesin fiber layer contains a fluororesin fiber. Preferably, the contacting member further includes a substrate, and the fluororesin fiber layer is directly or indirectly fixed to the substrate. Here, the case in which the fluororesin fiber layer is directly fixed to the substrate refers to, for example, a case in which the fluororesin fiber layer and the substrate are integrated by heat fusion, an adhesive such as a primer, or a combination thereof. The case in which the fluororesin fiber layer is indirectly fixed to the substrate refers to, for example, a case in which one or more base layers are provided between the fluororesin fiber layer and the substrate, where an integration is achieved between the fluororesin fiber layer and the base layer, between the base layers, or between the base layer and the substrate, by heat fusion, an adhesive such as a primer, or a combination thereof.

Fluororesin Fiber Layer

The contacting member according to an embodiment of the present invention has a fluororesin fiber layer on a surface which contacts the contacted member, and the fluororesin fiber layer contains a fluororesin fiber. Preferably, the fluororesin fiber layer contains the fluororesin fiber at the outermost surface of the layer. The fluororesin fiber improves lubricity and detachability with respect to the region of the contacted member to which a liquid composition has been applied, which directly contacts the fluororesin fiber. Examples of fluororesin constituting the fluororesin fiber include, but are not limited to, tetrafluoroethylene-perfluoroalkyl vinyl ether copolymer (PFA, melting point: 300 to 310 degrees C.), polytetrafluoroethylene (PTFE, melting point: 330 degrees C.), tetrafluoroethylene-hexafluoropropylene copolymer (FEP, melting point: 250 to 280 degrees C.), ethylene-tetrafluoroethylene copolymer (ETFE, melting point: 260 to 270 degrees C.), polyvinylidene fluoride (PVDF, melting point: 160 to 180 degrees C.), polychlorotrifluoroethylene (PCTFE, melting point: 210 degrees C.), tetrafluoroethylene-hexafluoropropylene-perfluoroalkyl vinyl ether copolymer (EPE, melting point: 290 to 300 degrees C.), and copolymers including the above-described polymers. Among these, polytetrafluoroethylene (PTFE) is preferred.

The fluororesin fiber may be formed by spinning the fluororesin or hardening short fibers of the fluororesin. The fluororesin fiber may be any of a resin fiber made of a single fluororesin, a resin fiber made of a plurality of fluororesins, or a resin fiber in which the fluororesin and a material other than the fluororesin are mixed. Among these, a resin fiber made of a single fluororesin and a resin fiber made of a plurality of fluororesins are preferred. In the present embodiment, the fluororesin fiber refers to a fiberized product of the fluororesin itself or that of a mixture itself of the fluororesin and a material other than the fluororesin. Therefore, for example, those obtained by coating and hardening the surface of a glass resin fiber with a fluororesin are not included in the fluororesin fiber of the present embodiment.

Examples of commercially-available fluororesin fibers include, but are not limited to, TOYOFLON BF800S, 2402, and 1412 (manufactured by Toray Industries, Inc.), all of which are fluororesin fibers containing polytetrafluoroethylene (PTFE).

The fluororesin fiber layer has an average deformation amount of from 5.0 to 18.0 μm/N, preferably from 8.0 to 12.0 μm/N, which is calculated from a displacement amount obtained when a circular indenter having a diameter of 5 mm is pushed into the fluororesin fiber layer. The average deformation amount of the fluororesin fiber layer is an index indicating the hardness of the fluororesin fiber layer.

A method for measuring the average deformation amount of the fluororesin fiber layer in the present embodiment is described below. The average deformation amount of the fluororesin fiber layer may be measured by a compact table-top tester EZ-SX (manufactured by Shimadzu Corporation), but the measuring instrument is not limited thereto. A circular indenter having a diameter 5 mm is attached to the tip of the tester, then the contacting member is set to the tester, and the circular indenter is brought into contact with the fluororesin fiber layer of the contacting member. The load at the initial contact is set to 0 N, and the displacement amount when the indenter is pushed at a speed of 0.02 mm/sec until a stress of 0.5 N is generated is defined as a displacement amount 1. In addition, the displacement amount when the indenter is pushed until a stress of 3.3 N is generated is defined as a displacement amount 2. Based on the displacement amount 1 and the displacement amount 2, the deformation amount is calculated from the following equation (1). The deformation amount is determined in this way at 10 different measurement positions, and the average value thereof is defined as the average deformation amount of the fluororesin fiber layer. Preferably, the 10 measurement positions are so selected that the variation in deformation amount is not excessively large. Therefore, for example, it is preferable that the measurement is performed at the central portion of the fluororesin fiber layer and not at the end portions.

$$\text{Deformation Amount}(\mu m/N)=(\text{Displacement Amount 2}-\text{Displacement Amount 1})/2.8 \quad \text{Equation (1)}$$

Figure 1B:
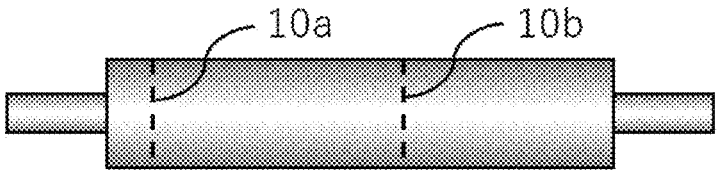
Figure 1C:
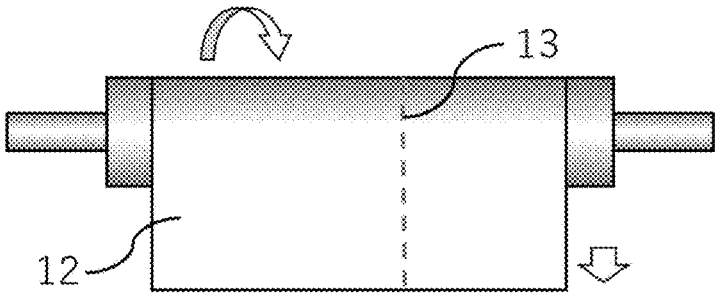

Next, the reason why the average deformation amount of the fluororesin fiber layer is adjusted to be in the range of from 5.0 to 18.0 μm/N is described with reference to FIGS. 1A to 1C. FIGS. 1A to 1C are schematic diagrams illustrating a situation in which a roller-shaped contacting member conveys a contacted member.

As illustrated in FIG. 1A, when a contacted member 11 (e.g., recording medium) is conveyed under the situation in which a contacting member 10 having a fluororesin fiber layer on its surface and the contacted member 11 are in pressure contact with each other, as illustrated in FIG. 1B, minute steps 10*a* and 10*b* are formed on the fiber layer at a boundary between a region that has been in contact with the contacted member 11 and another region that has not been in contact with the contacted member 11 due to the difference in the degree of compression of the fluororesin fiber layer. After that, as illustrated in FIG. 1C, when another contacted member 12 to which a liquid composition has been applied is conveyed over the minute step 10*b*, an abnormal image 13 (e.g., image defect) may be generated in the image formed by the applied liquid composition at a portion which has passed through the minute step 10*b*. To prevent generation of the abnormal image 13, the fluororesin fiber layer may be compressed in advance by application of pressure such that the average deformation amount of the fluororesin fiber layer is adjusted to be in the range of from 5.0 to 18.0 μm/N. When the average deformation amount is within this range, even when a minute step is formed, the angle of the step is gentle and the height of the step is not large. Therefore, the contact pressure between the contacting member and the contacted member becomes small, and generation of an abnormal image (e.g., image defect) is prevented. When the average deformation amount is smaller than 5.0 μm, a fiber structure having voids is insufficiently formed in the contacting member, and therefore the minute step has a sharp-angled edge. As a result, an abnormal image (e.g., image defect) is likely to be generated. When the average deformation amount is larger than 18.0 μm, a fiber structure having voids is excessively formed in the contacting member, and therefore the height of the minute step becomes large. As a result, an abnormal image (e.g., image defect) is likely to be generated. In the case of adjusting the average deformation amount by compressing the fluororesin fiber layer by application of pressure, the timing of applying pressure is not particularly limited. For example, application of pressure may be performed before the fluororesin fiber layer is fixed to the substrate or base layer with an adhesive or the like, or after the fluororesin fiber layer is fixed to the substrate or base layer with an adhesive or the like.

The thickness of the fluororesin fiber layer is preferably 200 μm or more, and more preferably 300 μm or more. In addition, the thickness of the fluororesin fiber layer is preferably 800 μm or less, and more preferably 700 μm or less. When the surface of the contacting member has a fiber structure and the thickness of the layer having the fiber structure is 200 μm or more, even when the contacting member comes into contact with the contacted member with a high pressure therebetween, the pressure is dispersed in the direction perpendicular to the plane of contact of the contacting member with the contacted member. Thus, even when the contacting member contacts a region of the contacted member to which a liquid composition has been applied, the liquid composition on the contacted member is prevented from being transferred onto the contacting member. Further, when the thickness of the layer having the fiber structure is 800 μm or less, the contacted member is satisfactorily conveyed even when the contacting member is used as a roller for conveying the contacted member. Further, when the thickness of the layer having the fiber structure is from 300 to 700 μm, the liquid composition on the contacted member is more prevented from being transferred onto the contacting member. When the thickness of the fluororesin fiber layer is 300 μm or more, the pressure is more dispersed in the direction perpendicular to the plane of contact of the contacting member with the contacted member. When the thickness of the fluororesin fiber layer is 700 μm or less, the fiber structure is prevented from sagging due to friction between the fluororesin fiber layer and the contacted member.

The shape of the fluororesin fiber layer is not particularly limited, but the fluororesin fiber layer is preferably in a sheet-like shape and wound around a substrate. The term "sheet-like" refers to a state in which fibers are processed so as not to be easily separated from each other, so that the fluororesin fiber layer is in a flat or curved shape, and does not refer to a linear state. The process for making fibers not easily separated from each other may be a known process such as a process of mechanically weaving fibers spun by extrusion of raw materials or a process of joining fibers by heat or pressure. In particular, a process of joining fibers having a relatively short length is preferred for the advantage that the number of contact points can be increased while reducing the area of contact. As the fluororesin fiber layer is in a sheet-like shape, a portion of the contacting member which contacts the contacted member becomes the top portion of the fluororesin fiber located at the outermost part of the fluororesin fiber layer. Thus, a large number of the top portions of the fluororesin fibers is made present on the surface of the contacting member while reducing the contact area between the contacting member and the contacted member. Therefore, even when the contacting member contacts a region of the contacted member to which a liquid composition has been applied, the liquid composition on the contacted member is prevented from being transferred onto the contacting member. In the present embodiment, the fluororesin fiber layer which is formed by winding linear fibers around a substrate is not excluded, but the fluororesin fiber layer having the above-described sheet-like shape is preferred. When the fluororesin fiber layer is in a sheet-like shape, the pressure generated between the contacting member and the contacted member is more dispersed as compared with the case in which the fluororesin fiber layer is in a linear shape. Therefore, the liquid composition on the contacted member is prevented from being transferred onto the contacting member.

Preferably, the fluororesin fiber layer has an air permeability of from 4 to 16 seconds, for preventing image detachment. When the air permeability is 4 seconds or more, the pressure from the contacted member at the plane of contact is effectively dispersed, thus improving the effect of preventing image detachment. When the air permeability is 16 seconds or less, the contacting member is prevented from closely adhering to the contacted member, thus improving the effect of preventing image detachment. In the present embodiment, the air permeability is measured by a Gurley automatic air permeability meter (manufactured by YASUDA SEIKI SEISAKUSHO, LTD.) according to a method based on ISO 5636. More specifically, the time required for 300 ml of air to pass through the fluororesin fiber layer with respect to a passage diameter of 10 mm is measured. The measurement is performed at 10 different positions, and the average value is defined as the air permeability.

Substrate

Preferably, the substrate is a long rod-shaped body made of a metal. More preferably, the substrate is a roller-shaped body such as a columnar or cylindrical body having a circular cross section. When the substrate has such a shape, the contacting member can be used as a roller for conveying the contacted member. When the contacting member is used as the roller, the diameter of the circular cross section of the substrate is preferably from 50 to 100 mm. When the diameter is within this range, even when the contacting member contacts a region of the contacted member to which a liquid composition has been applied, the liquid composition on the contacted member is prevented from being transferred onto the contacting member. When the diameter is 50 mm or more, the pressure per unit area generated between the contacting member and the contacted member is reduced, and the liquid composition is prevented from being transferred. When the diameter is 100 mm or less, the occurrence of slippage is prevented between the contacting member and the contacted member, thereby preventing the liquid composition from being transferred.

Examples of the material of the substrate include, but are not limited to, various metals such as stainless steel and aluminum, sintered bodies of metals such as copper and stainless steel, and ceramic sintered bodies.

Drying Device and Printing Apparatus A drying device according to an embodiment of the present invention is configured to dry a contacted member to which a liquid composition has been applied. The drying device includes the above-described contacting member, and optionally a liquid composition heater configured to heat the liquid composition applied to the contacted member, a contacting member heater configured to heat the contacting member, and the like, as necessary.

A printing apparatus according to an embodiment of the present invention includes the above-described contacting member, and optionally a contacted member feeder configured to feed a contacted member, a conveyance path for conveying the contacted member, a liquid composition applicator configured to apply a liquid composition to the contacted member, a liquid composition heater configured to heat the liquid composition applied to the contacted member, a contacting member heater configured to heat the contacting member, a contacted member collector configured to collect the contacted member, and the like, as necessary.

Figure 2:
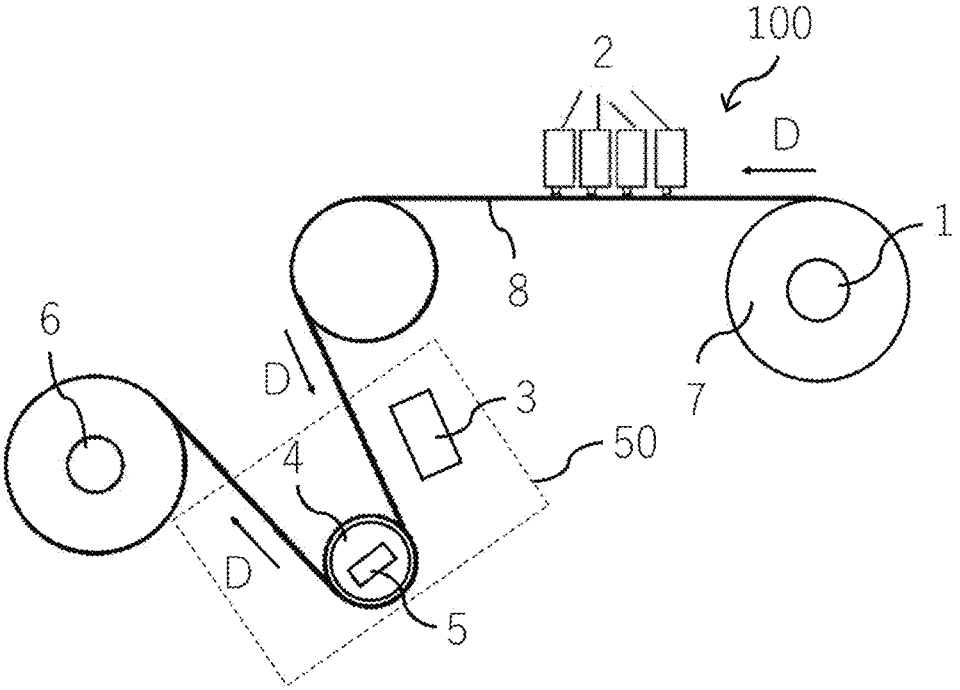
FIG. 2 is a schematic diagram illustrating a printing apparatus that uses continuous sheet.

The drying device and the printing apparatus are described in detail below with reference to FIG. 2. FIG. 2 is a schematic diagram illustrating a printing apparatus that uses continuous sheet. A printing apparatus 100 illustrated in FIG. 2 includes a contacted member feeder 1, a liquid composition applicator 2, a liquid composition heater 3, a contacting member 4, a contacting member heater 5, and a contacted member collector 6. The printing apparatus 100 includes a drying device 50. The drying device 50 may be an apparatus either integrated with or separated from the printing apparatus.

Contacted Member Feeder

The contacted member feeder 1 is rotationally driven to feed a contacted member 7 stored wound in a roll to a conveyance path 8 in the printing apparatus 100. The conveyance direction of the contacted member 7 in the conveyance path 8 is indicated by an arrow D in FIG. 2.

The rotary drive of the contacted member feeder 1 is adjusted such that the contacted member 7 is conveyed at a high speed of 50 m/min or higher.

The contacted member 7 is a sheet-like object to be conveyed that is continuous in the conveyance direction D in the printing apparatus 100. Specific examples thereof include a recording medium such as a continuous sheet. Examples of the continuous sheet include, but are not limited to, a rolled sheet and a folded sheet folded at predetermined intervals. The contacted member 7 is conveyed along the conveyance path 8 between the contacted member feeder 1 and the contacted member collector 6. The length of the contacted member 7 in the conveyance direction D is longer than at least the length of the conveyance path 8 provided for conveying the contacted member 7 between the contacted member feeder 1 and the contacted member collector 6. The printing apparatus 100 of the present embodiment uses the contacted member 7 that is continuous in the conveyance direction D in the printing apparatus 100. To convey the contacted member 7 at a high speed, a large tension is applied to the contacted member 7 between the contacted member feeder 1 and the contacted member collector 6.

Liquid Composition Applicator

The liquid composition applicator 2 is an inkjet discharge head having a plurality of nozzle arrays in each of which a plurality of nozzles is arranged. The liquid composition applicator 2 is disposed such that the direction of discharge of ink from the nozzles is directed to the conveyance path 8 for conveying the contacted member 7. Thus, the liquid composition applicator 2 sequentially applies to the contacted member 7 magenta (M), cyan (C), yellow (Y), and black (K) inks and an aftertreatment liquid for protecting the surface of the applied ink, each serving as a liquid composition. The colors of the discharged inks are not limited to these, and may be white, gray, silver, gold, green, blue, orange, violet, or the like.

In the present embodiment, the case in which the liquid composition is an ink and an aftertreatment liquid is illustrated, but the liquid composition is not limited thereto. Examples thereof include, but are not limited to, an ink, a pretreatment liquid for coagulating a colorant contained in the ink, an aftertreatment liquid for protecting the surface of the applied ink, and an electric circuit forming liquid dispersing inorganic particles (e.g., metal particles). These may be appropriately mixed or applied superimposed each other.

In the present embodiment, the case in which the liquid composition is applied to the contacted member 7 by the inkjet discharge head is illustrated, but the liquid composition may be applied by other devices or methods. For example, various known methods such as spin coating, spray coating, gravure roll coating, reverse roll coating, and bar coating may be used.

Liquid Composition Heater

The liquid composition heater 3 heats the liquid composition applied to the contacted member 7 from the back side of the surface of the contacted member 7 having the region to which the liquid composition has been applied. The liquid composition heater 3 is not particularly limited. Examples thereof include various known devices such as a hot air blower, and a dryer that brings the back surface of the contacted member 7 into contact with a heating roller, a flat heater, or the like.

Contacting Member

The contacting member 4 changes the conveyance direction D of the contacted member 7 while conveying the contacted member 7. The contacting member 4 is a columnar or cylindrical roller.

In the printing apparatus 100 of the present embodiment, as described above, the contacted member feeder 1 conveys the contacted member 7 at a speed of 50 m/min or higher. In such a high-speed conveyance, as illustrated in FIG. 2, when the conveyance direction of the contacted member 7 is changed by the contacting member 4, a large pressure is applied between the contacting member 4 and the contacted member 7. Therefore, it is likely that a minute step is formed on the fluororesin fiber layer of the contacting member 4 at a boundary between a region contacting the contacted member 7 and another region not contacting the contacted member 7. Accordingly, when the contacted member 7 is thereafter conveyed over the minute step, an abnormal image is likely to be generated. Thus, the contacting member according to the present embodiment is preferably used. In addition, when the contacting member 4 comes into contact with the region on the contacted member 7 to which the liquid composition has been applied, the liquid composition is likely to be transferred onto the contacting member 4. Therefore, the contacting member according to the present embodiment is preferably used.

As described above, the printing apparatus 100 of the present embodiment uses the contacted member 7 that is continuous in the conveyance direction D in the printing apparatus 100. To convey the contacted member 7 at a high speed, a large tension is applied to the contacted member 7 between the contacted member feeder 1 and the contacted member collector 6. In such a case, as illustrated in FIG. 2, when the conveyance direction of the contacted member 7 that is applied with a large tension is changed by the contacting member 4, a large pressure is applied between the contacting member 4 and the contacted member 7. Therefore, it is likely that a minute step is formed on the fluororesin fiber layer of the contacting member 4 at a boundary between a region contacting the contacted member 7 and another region not contacting the contacted member 7. Accordingly, when the contacted member 7 is thereafter conveyed over the minute step, an abnormal image is likely to be generated. Thus, the contacting member according to the present embodiment is preferably used. In addition, when the contacting member 4 comes into contact with the region on the contacted member 7 to which the liquid composition has been applied, the liquid composition is likely to be transferred onto the contacting member 4. Therefore, the contacting member according to the present embodiment is preferably used.

As illustrated in FIG. 2, the contacting member 4 is disposed downstream from the liquid composition heater 3 in the conveyance direction D of the contacted member 7.

The contacting member 4 comes into contact with the region of the contacted member 7 to which the liquid composition has been applied after the liquid composition on the contacted member 7 has been dried by the liquid composition heater 3. Therefore, the liquid composition is more prevented from being transferred onto the contacting member 4, which is preferable.

Further, it is preferable that the member that first comes into contact with the region of the contacted member 7 to which the liquid composition has been applied after the liquid composition on the contacted member 7 has been dried by the liquid composition heater 3 be the contacting member 4. Because the liquid composition is likely to be transferred onto the member that first comes into contact with the region of the contacted member 7 to which the liquid composition has been applied, the contacting member according to the present embodiment is preferably used as that member.

When the contacting member 4 is a roller, as illustrated in FIG. 2, as the contacted member 7 comes to wind around the roller, the roller comes into contact with the region of the contacting member 7 to which the liquid composition has been applied. At this time, a winding ratio of the contacted member 7 with respect to the roller is preferably 10% or more, more preferably 15% or more, and much more preferably 20% or more. When the winding ratio is 10% or more, the pressure per unit area generated between the roller and the contacted member 7 is reduced, and the liquid composition is prevented from being transferred onto the roller. In addition, the winding ratio of the contacted member 7 with respect to the roller is preferably 90% or less, more preferably 70% or less, and much more preferably 50% or less. When the winding ratio is 50% or less, the contacted member 7 can be suitably conveyed.

Figure 3:
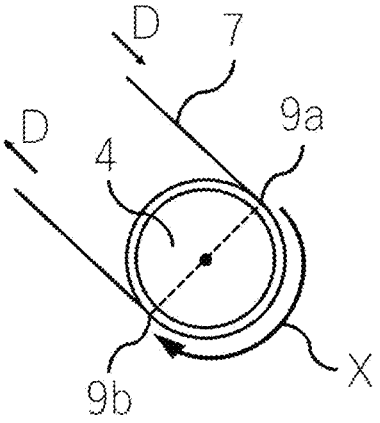
FIG. 3 is a schematic diagram illustrating a situation in which the contacted member is in contact with the contacting member.

The "winding ratio" in the present embodiment is described in detail below with reference to FIG. 3. FIG. 3 is a schematic diagram illustrating a situation in which the contacted member is in contact with the contacting member. When the contacted member 7 is in contact with the contacting member 4 in a roller shape as being wound around the contacting member 4, as illustrated in FIG. 3, the "winding ratio" is defined as the ratio of a circumferential length X of the contacting member 4 between end portions 9*a* and 9*b* to the total circumferential length of the contacting member 4. Here, the circumferential length X is defined on a side where the contacted member 7 and the contacting member 4 is contacting, and the end portions 9*a* and 9*b* are portions at each of which the contacted member 7 separates from the contacting member 4.

Contacting Member Heater

The contacting member heater 5 heats the contacting member 4. The heated contacting member 4 comes into contact with the region of the contacted member 7 to which the liquid composition has been applied, thereby drying the region of the contacted member 7 to which the liquid composition has been applied. At this time, not only when the liquid composition is insufficiently dried but also when the resin contained in the liquid composition is softened by heat, it is likely that the liquid composition is undesirably transferred onto the contacting member 4. Thus, the contacting member according to the present embodiment is preferably used.

Examples of the contacting member heater 5 include various known devices such as a heater and a hot air blower.

The contacting member heater 5 may be disposed either inside the contacting member 4 as illustrated in FIG. 2 or outside the contacting member 4. Further, the contacting member heater 5 may be provided either separately from the contacting member 4 or integrated with the contacting member 4. In a case in which the substrate of the contacting member 4 is a porous body and the contacting member heater 5 is disposed inside the contacting member 4, heat or hot air generated from the contacting member heater 5 can be efficiently transmitted to the contacted member 7.

Contacted Member Collector

The contacted member collector 6 rotary-drives to wind up in a roll the contacted member 7 on which an image has been formed with the liquid composition having been applied.

Printing Method

A printing method according to an embodiment of the present invention includes a liquid composition applying step for applying the liquid composition to the contacted member, and a contacting step in which the contacting member comes into contact with the region of the contacted member to which the liquid composition has been applied. The printing method further includes a liquid composition heating step, if necessary.

Liquid Composition Applying Step

The liquid composition applying step is a step for applying the liquid composition (e.g., ink) to the contacted member 7 fed by the contacted member feeder 1. As a result, a region to which the liquid composition has been applied is formed on the contacted member 7.

Liquid Composition Heating Step

The liquid composition heating step is a step for drying the applied liquid composition by application of heat after the liquid composition applying step. Preferably, the drying is performed to such an extent that the recording medium becomes not sticky. The applied liquid composition may be either dried by the liquid composition heater 3 as illustrated in FIG. 2 or dried naturally without using any drying device.

Contacting Step

The contacting step is a step in which the contacting member 4 comes into contact with the region of the contacted member 7 to which the liquid composition has been applied. The region to which the liquid composition has been applied refers to a region on the surface of the contacted member 7 to which the liquid composition has been applied and excludes a region on the opposite surface to which the liquid composition has not been applied. Further, the region to which the liquid composition has been applied indicates a location specified by the application of the liquid composition, regardless of the state of the liquid composition. In other words, at the time when the contacting member comes into contact with the region to which the liquid composition has been applied, the liquid composition needs not to be maintained in a liquid state that is the state at when the liquid composition was applied to this region. The liquid composition may be in a liquid state in which a part of the liquid components in the liquid composition has been vaporized or may be in a solid state in which all the liquid components in the liquid composition have been vaporized.

As illustrated in FIG. 2, the contacted member 7 is conveyed while being in contact with the contacting member 4. Further, the contacting member 4 changes the conveyance direction D of the contacted member 7 by conveying the contacted member 7 so as to be wound therearound. Furthermore, when the contacting member heater 5 is disposed inside or near the contacting member 4, the contacting member 4 dries the region on the contacted member 7 to which the liquid composition has been applied while conveying the contacted member 7.

Liquid Composition

The liquid composition according to an embodiment of the present invention is not particularly limited. Examples thereof include, but are not limited to, an ink, a pretreatment liquid for coagulating a colorant contained in the ink, an aftertreatment liquid for protecting the surface of the applied ink, and an electric circuit forming liquid dispersing inorganic particles (e.g., metal particles). These can be appropriately used in a known composition. Hereinafter, a case in which an ink and an aftertreatment liquid are each used as the liquid composition is described as an example.

Ink

Compositional materials of the ink, such as organic solvents, water, colorants, resins, waxes, and additives, are described in detail below.

Organic Solvent

The organic solvent is not particularly limited and water-soluble organic solvents can be used. Examples thereof include, but are not limited to, polyols, ethers such as polyol alkyl ethers and polyol aryl ethers, nitrogen-containing heterocyclic compounds, amides, amines, and sulfur-containing compounds.

Specific examples of the polyols include, but are not limited to, ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and 3-methyl-1,3,5-pentanetriol.

Specific examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzyl ether.

Specific examples of the nitrogen-containing heterocyclic compounds include, but are not limited to, 2-pyrrolidone, N-methyl-2-pyrrolidone, N-hydroxyethyl-2-pyrrolidone, 1,3-dimethyl-2-imidazolidinone, ε-caprolactam, and γ-butyrolactone.

Specific examples of the amides include, but are not limited to, formamide, N-methylformamide, N,N-dimethylformamide, 3-methoxy-N,N-dimethylpropionamide, and 3-butoxy-N,N-dimethylpropionamide.

Specific examples of the amines include, but are not limited to, monoethanolamine, diethanolamine, and triethylamine.

Specific examples of the sulfur-containing compounds include, but are not limited to, dimethylsulfoxide, sulfolane, and thiodiethanol.

Specific examples of other organic solvents include, but are not limited to, propylene carbonate and ethylene carbonate.

In particular, organic solvents having a boiling point of 250 degrees C. or less are preferred, since they not only function as wetting agents but also provide good drying property.

Preferred examples of the organic solvent further include polyol compounds having 8 or more carbon atoms and glycol ether compounds. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

In particular, when a resin is used as an ink composition, N,N-dimethyl-β-butoxypropionamide, N,N-dimethyl-β-ethoxypropionamide, 3-ethyl-3-hydroxymethyloxetane, and propylene glycol monomethyl ether are preferred. Each of these can be used alone or in combination with others. Among these, amide solvents such as 3-butoxy-N,N-dimethylpropionamide and 3-methoxy-N,N-dimethylpropionamide are particularly preferred. In this case, formation of the resin film is promoted and high abrasion resistance is expressed.

Preferably, the organic solvent has a boiling point of from 180 to 250 degrees C. When the boiling point is 180 degrees C. or higher, the evaporation rate during drying can be appropriately adjusted, leveling is sufficiently performed, surface irregularities are reduced, and glossiness can be improved. By contrast, when the boiling point is higher than 250 degrees C., drying property is low, which may require drying for a long period of time. With the recent speeding up of printing technology, the time required for drying the ink has become rate-determining and the drying time should be shortened. Drying for a long period of time is not preferred.

The proportion of the organic solvent in the ink is not particularly limited and can be suitably selected to suit to a particular application, but is preferably from 10% to 60% by mass, more preferably from 20% to 60% by mass, for drying property and discharge reliability of the ink.

The proportion of the amide solvent in the ink is preferably from 0.05% to 10% by mass, more preferably from 0.1% to 5% by mass.

Water

The proportion of water in the ink is not particularly limited and can be suitably selected to suit to a particular application, but is preferably from 10% to 90% by mass, more preferably from 20% to 60% by mass, for drying property and discharge reliability of the ink.

Colorant

The colorant is not particularly limited, and pigments and dyes can be used as the colorant. Usable pigments include both inorganic pigments and organic pigments. Each of these may be used alone or two or more of these may be used in combination. Mixed crystals can also be used as the pigments.

Usable pigments include black pigments, yellow pigments, magenta pigments, cyan pigments, white pigments, green pigments, orange pigments, glossy color pigments (e.g., gold pigments and silver pigments), and metallic pigments.

Specific examples of inorganic pigments include, but are not limited to, titanium oxide, iron oxide, calcium carbonate, barium sulfate, aluminum hydroxide, Barium Yellow, Cadmium Red, Chrome Yellow, and carbon black produced by a known method such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, quinophthalone pigments), dye chelates (e.g., basic dye chelate, acid dye chelate), nitro pigments, nitroso pigments, and aniline black. Among these pigments, those having good affinity for solvents are preferred. In addition, hollow resin particles and hollow inorganic particles can also be used.

Specific examples of pigments used for black-and-white printing include, but are not limited to, carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1).

Specific examples of pigments used for color printing include, but are not limited to: C.I. Pigment Yellow 1, 3, 12, 13, 14, 17, 24, 34, 35, 37, 42 (Yellow Iron Oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, 48:2 (Permanent Red 2B (Ca)), 48:3, 48:4, 49:1, 52:2, 53:1, 57:1 (Brilliant Carmine 6B), 60:1, 63:1, 63:2, 64:1, 81, 83, 88, 101 (Red Iron Oxide), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4 (Phthalocyanine Blue), 16, 17:1, 56, 60, and 63; and C.I. Pigment Green 1, 4, 7, 8, 10, 17, 18, and 36.

The dyes are not particularly limited, and acid dyes, direct dyes, reactive dyes, and basic dyes can be used. Each of these can be used alone or in combination with others.

Specific examples of the dyes include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. 1. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the colorant in the ink is preferably from 0.1% to 15% by mass, more preferably from 1% to 10% by mass, for improving image density, fixability, and discharge stability.

The pigment can be dispersed in the ink by any of the following methods: introducing a hydrophilic functional group to the pigment to make the pigment self-dispersible; covering the surface of the pigment with a resin; and dispersing the pigment by a dispersant.

In the method of introducing a hydrophilic functional group to the pigment to make the pigment self-dispersible, for example, a functional group such as sulfone group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. This pigment may be referred to as a resin-covered pigment. In this case, not all the pigment particles included in the ink should be covered with a resin. It is possible that a part of the pigment particles is not covered with any resin or partially covered with a resin.

In the method of dispersing the pigment by a dispersant, low-molecular dispersants and high-molecular dispersants, represented by known surfactants, may be used.

More specifically, any of anionic surfactants, cationic surfactants, ampholytic surfactants, and nonionic surfactants may be used as the dispersant depending on the property of the pigment.

For example, a nonionic surfactant RT-100 (available from Takemoto Oil & Fat Co., Ltd.) and sodium naphthalenesulfonate formalin condensate are preferably used as the dispersant.

Each of the above dispersants may be used alone or in combination with others.

Pigment Dispersion

The ink can be obtained by mixing a pigment with other materials such as water and an organic solvent. The ink can also be obtained by, first, preparing a pigment dispersion by mixing a pigment with water, a dispersant, etc., and thereafter mixing the pigment dispersion with other materials such as water and an organic solvent.

The pigment dispersion can be obtained by mixing water, a pigment, a pigment dispersant, and other components, if any, to disperse the pigment, and adjusting the particle diameter of the pigment. Preferably, the dispersing is performed by a disperser.

The particle diameter of the pigment dispersed in the pigment dispersion is not particularly limited, but the number-based maximum frequency particle diameter is preferably in the range of from 20 to 500 nm, more preferably from 20 to 150 nm, for improving dispersion stability of the pigment and discharge stability and image quality (e.g., image density) of the ink. The particle diameter of the pigment can be measured with a particle size analyzer (NANOTRAC WAVE-UT151 available from MicrotracBEL Corp.).

The proportion of the pigment in the pigment dispersion is not particularly limited and can be suitably selected to suit to a particular application, but is preferably from 0.1% to 50% by mass, more preferably from 0.1% to 30% by mass, for improving discharge stability and enhancing image density.

Preferably, the pigment dispersion is subjected to filtration using a filter or a centrifugal separator to remove coarse particles, followed by degassing.

Resin

The type of the resin contained in the ink is not particularly limited and can be suitably selected to suit to a particular application. Specific examples thereof include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins.

Resin particles made of these resins may also be used. The resin particles may be dispersed in water serving as a dispersion medium to prepare a resin emulsion. The ink can be obtained by mixing the resin emulsion with other materials such as a colorant and an organic solvent. These resin particles are available either synthetically or commercially. The resin particles may include one type or two or more types of resin particles.

Among these, urethane resin particles are preferably used in combination with other resin particles because an image formed with an ink containing urethane resin particles has so large a tackiness that blocking resistance is deteriorated. On the other hand, the large tackiness of urethane resin particles makes it possible to firmly form an image with an improve fixability. In addition, an image formed with an ink containing urethane resin particles having a glass transition temperature (Tg) of from −20 to 70 degrees C. have a greater tackiness and fixability is more improved.

Among the above resins, acrylic resin particles containing an acrylic resin are widely used because of their excellent discharge stability and low cost. However, because of poor rub resistance, acrylic resin particles are preferably used in combination with urethane resin particles having elasticity.

The mass ratio (urethane resin particles/acrylic resin particles) of urethane resin particles to acrylic resin particles in the ink is preferably from 0.03 to 0.7, more preferably from 0.1 to 0.7, and most preferably from 0.23 to 0.46.

The volume average particle diameter of the resin particles is not particularly limited and can be suitably selected to suit to a particular application, but is preferably from 10 to 1,000 nm, more preferably from 10 to 200 nm, and particularly preferably from 10 to 100 nm, for good fixability and high image hardness.

The volume average particle diameter can be measured with a particle size analyzer (NANOTRAC WAVE-UT151 available from MicrotracBEL Corp.).

The proportion of the resin in the ink is not particularly limited and can be suitably selected to suit to a particular application, but is preferably from 1% to 30% by mass, more preferably from 5% to 20% by mass, for fixability and storage stability of the ink.

The particle size of solid contents in the ink is not particularly limited and can be suitably selected to suit to a particular application. The number-based maximum frequency particle diameter of solid contents in the ink is preferably in the range of from 20 to 1,000 nm, more preferably from 20 to 150 nm, for improving discharge stability and image quality (e.g., image density). The solid contents include the resin particles and pigment particles. The particle diameter can be measured with a particle size analyzer (NANOTRAC WAVE-UT151 available from MicrotracBEL Corp.).

Wax

When the ink contains a wax, rub resistance is improved. When the ink contains a wax in combination with the resin, glossiness is improved. Preferred examples of the wax include a polyethylene wax. Examples of commercially-available products of the polyethylene wax include, but are not limited to, AQUACER 531 (manufactured by BYK Japan KK), POLYRON P-502 (manufactured by Chukyo Yushi Co., Ltd.), AQUAPETRO DP2502C (manufactured by TOYO ADL CORPORATION), and AQUAPETRO DP2401 (manufactured by TOYO ADL CORPORATION). Each of these can be used alone or in combination with others.

The proportion of the polyethylene wax the ink is preferably from 0.05% to 2% by mass, more preferably from 0.05% to 0.5% by mass, much more preferably from 0.05% to 0.45% by mass, and most preferably from 0.15% to 0.45% by mass. When the proportion is from 0.05% to 2% by mass, rub resistance and glossiness are sufficiently improved. When the proportion is 0.45% by mass or less, storage stability and discharge stability of the ink are particularly good, and the ink is more suitable for use in an inkjet system.

Additives

The ink may further contain a surfactant, a defoamer, a preservative, a fungicide, a corrosion inhibitor, and/or a pH adjuster.

Aftertreatment Liquid

The aftertreatment liquid is not particularly limited as long as it is capable of forming a transparent layer. The aftertreatment liquid may be prepared by mixing the same organic solvent used for the ink, water, a resin, a surfactant, a defoamer, a pH adjuster, a preservative, a fungicide, and/or a corrosion inhibitor, selected according to the need. The aftertreatment liquid can be applied to the entire region of the contacted member or only to the region to which an ink has been applied.

Contacted Member

The contacted member is not particularly limited. Examples thereof include, but are not limited to, recording media such as plain paper, gloss paper, special paper, and cloth. In particular, low-permeability recording medium (also referred to as "low-absorptivity recording media") are suitable.

The low-permeability recording media refer to recording media having a surface with a low level of moisture permeability, absorptivity, and/or adsorptivity, and include a material having a number of hollow spaces inside but not opened to the exterior. Examples of the low-permeability recording media include, but are not limited to, coated papers used in commercial printing, and recording media such as paperboard in which waste paper pulp is blended into the intermediate layer and the back layer and a coating is provided on the surface. In a case in which such a low-permeability recording medium is used, when the contacting member comes into contact with the region on the contacted member to which the liquid composition has been applied, the liquid composition is likely to be transferred onto the contacting member. Therefore, the contacting member according to the present embodiment is preferably used.

Low-Permeability Recording Media

Examples of the low-permeability recording media include, but are not limited to, a recording medium such as a coated paper having a support substrate, a surface layer provided on at least one surface of the support substrate, and optionally other layers as necessary.

In a recording medium having a support substrate and a surface layer, the transfer amount of pure water to the recording medium within a contact time of 100 ms, measured by a dynamic scanning absorptometer, is preferably from 2 to 35 mL/m$^2$, more preferably from 2 to 10 mL/m$^2$.

When the transfer amount of pure water within a contact time of 100 ms is too small, beading (i.e., a phenomenon in which adjacent dots attract each other to make the image surface rough) is likely to occur. When the transfer amount is too large, the ink dot diameter in the image may become too smaller than a desired diameter.

In addition, the transfer amount of pure water to the recording medium within a contact time of 400 ms, measured by a dynamic scanning absorptometer, is preferably from 3 to 40 mL/m$^2$, more preferably from 3 to 10 mL/m$^2$.

When the transfer amount of pure water within a contact time of 400 ms is too small, drying property is insufficient. When the transfer amount is too large, it is likely that the dried image has low glossiness. The transfer amount of pure water within a contact time of 100 ms or 400 ms is measured at the surface of the recording medium which has a surface layer thereon.

The dynamic scanning absorptometer ("DSA") is an instrument capable of accurately measuring the amount of liquid absorption within an extremely short time period, as disclosed in a paper entitled "Development and application of dynamic scanning absorptometer—Automation and improvement of Bristow measurement-", Shigenori Kuga, et al., Japan Tappi Journal, Volume 48, 1994, No. 5, pp. 88-92.

The dynamic scanning absorptometer provides an automated measurement that involves directly measuring the rate of liquid absorption by tracking the motion of meniscus in a capillary, spirally scanning a liquid supply head on a disc-shaped specimen, and automatically varying the scanning speed according to the preset pattern to perform the measurement required number of times using a single specimen.

The liquid supply head for supplying a liquid to a paper specimen is connected to the capillary via a TEFLON (registered trademark) tube. The position of meniscus is automatically tracked by an optical sensor. In particular, the transfer amount of pure water or ink may be measured by a dynamic scanning absorptometer K350 series D type (available from Kyowa Co., Ltd.).

The transfer amount within a contact time period of 100 ms or 400 ms is determined by interpolating the transfer amounts measured within contact time periods near 100 ms or 400 ms.

Support Substrate

The support substrate is not particularly limited and can be suitably selected to suit to a particular application. Examples thereof include, but are not limited to, sheet-like materials such as wood-fiber-based paper and wood-fiber-and-synthetic-fiber-based non-woven fabric.

The thickness of the support substrate is not particularly limited and can be suitably selected to suit to a particular application, but is preferably from 50 to 300 μm.

The basis weight of the support substrate is preferably from 45 to 290 g/m$^2$.

Surface Layer

The surface layer contains a pigment and a binder, and optionally contains a surfactant and other components, as necessary.

Examples of the pigment include inorganic pigments and combinations of inorganic and organic pigments. Specific examples of the inorganic pigments include, but are not limited to, kaolin, talc, ground calcium carbonate, precipitated calcium carbonate, calcium sulfite, amorphous silica, titanium white, magnesium carbonate, titanium dioxide, aluminum hydroxide, calcium hydroxide, magnesium hydroxide, zinc hydroxide, and chlorite. Preferably, the amount of the inorganic pigment added to 100 parts by mass of the binder is 50 parts by mass or more.

Specific examples of the organic pigments include, but are not limited to, water-soluble dispersions of styrene-acrylic copolymer particles, styrene-butadiene copolymer particles, polystyrene particles, and polyethylene particles. Preferably, the amount of the organic pigment added to 100 parts by mass of all the pigments in the surface layer is from 2 to 20 parts by mass.

Preferably, the binder comprises a water-based resin. As the water-based resin, at least one of a water-soluble resin and a water-dispersible resin is preferably used. The water-soluble resin is not particularly limited and can be suitably selected to suit to a particular application. Examples thereof include, but are not limited to, polyvinyl alcohol, cation-modified polyvinyl alcohol, acetal-modified polyvinyl alcohol, polyester, polyurethane, and polyester-polyurethane copolymer.

The surfactant contained in the surface layer as needed is not particularly limited and can be suitably selected to suit to a particular application. Examples thereof include anionic surfactants, cationic surfactants, ampholytic surfactants, and nonionic surfactants.

A method for forming the surface layer is not particularly limited and can be suitably selected to suit to a particular application. Examples thereof include, but are not limited to, a method of impregnating or coating the support substrate with a surface layer constituting liquid. The adhered amount of the surface layer constituting liquid is not particularly limited and can be suitably selected to suit to a particular application, but is preferably from 0.5 to 20 g/m$^2$, more preferably from 1 to 15 g/m$^2$, on solid basis.

EXAMPLES

Further understanding of the present disclosure can be obtained by reference to certain specific examples provided herein below for the purpose of illustration only and are not intended to be limiting.

Preparation Example of Black Pigment Dispersion

First, 20 g of a carbon black (NIPEX 160 manufactured by Degussa AG, having a BET specific surface area of 150 m$^2$/g, an average primary particle diameter of 20 nm, a pH of 4.0, and a DBP oil absorption of 620 g/100 g), 20 mmol of a compound represented by the following structural formula (1), and 200 mL of ion-exchange high-purity water were mixed by a Silverson mixer at a revolution of 6,000 rpm at room temperature.

In a case in which the pH of the resulting slurry was higher than 4, 20 mmol of nitric acid was added thereto. Thirty minutes later, 20 mmol of sodium nitrite dissolved in a small amount of ion-exchange high-purity water was gently added to the above mixture. The mixture was further heated to 60 degrees C. while being stirred, then subjected to a reaction for 1 hour. As a result, a modified pigment in which the compound represented by the following structural formula (1) was adducted to carbon black was produced.

Next, the pH was adjusted to 10 by adding an NaOH aqueous solution, thus obtaining a modified pigment dispersion 30 minutes later. The modified pigment dispersion, containing the pigment bonded to at least one geminal bisphosphonic acid group or sodium geminal bisphosphonate, was subjected to ultrafiltration using ion-exchange high-purity water and a dialysis membrane and thereafter to ultrasonic dispersion. As a result, a self-dispersing black pigment dispersion having a solid pigment content concentration of 16% by mass was obtained. Here, the self-dispersing black pigment had bisphosphonate group as a hydrophilic functional group.

Structural Formula (1)

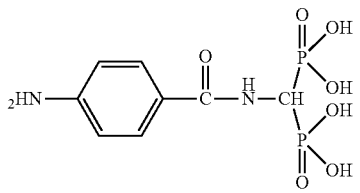

Preparation Example of Liquid Composition 1 (Ink)

A liquid composition 1 (ink) was prepared by mixing 50.00% by mass of the black pigment dispersion (having a solid pigment content concentration of 16%), 2.22% by mass of a polyethylene wax AQUACER 531 (containing 45% by mass of non-volatile contents, manufactured by BYK Japan KK), 30.00% by mass of 3-ethyl-3-hydroxymethyloxetane, 10.0% by mass of propylene glycol monopropyl ether, 2.00% by mass of a silicone-based surfactant (TEGO Wet 270, manufactured by Tomoe Engineering Co., Ltd.), and ion-exchange water in a balanced amount, then stirring the mixture for 1 hour, and filtering the mixture with a membrane filter having an average pore diameter of 1.2 μm.

Preparation Example of Liquid Composition 2 (Aftertreatment Liquid)

A liquid composition 2 (aftertreatment liquid) was prepared by mixing 22 parts of 1,3-butanediol, 11 parts of glycerin, 15 parts of a polyurethane emulsion SUPERFLEX 210 (manufactured by DKS Co. Ltd.) having a solid content concentration of 35% by mass, 2 parts of 2-ethyl-1,3-hexanediol, 0.05 parts of a fluorine-based nonionic surfactant CAPSTONE (registered trademark) FS-3100 (manufactured by DuPont de Nemours, Inc.), 0.1 parts of 2,4,7,9-tetramethyl-4,7-decanediol, 0.2 parts of a preservative and fungicide PROXEL LV (manufactured by AVECIA GROUP), 10 parts of a polyethylene wax POLYRON P502 (manufactured by Chukyo Yushi Co., Ltd.) having a solid content concentration of 30% by mass, and 39.65 parts of water.

Example 1

Preparation of Contacting Member

To the surface of an aluminum hollow roller having a diameter of 75 mm (available from MISUMI Group Inc.) serving as a substrate, TOMY FILEC PASLH (manufactured by TOMOEGAWA CO., LTD.), which was a fluororesin fiber layer having a thickness adjusted to 320 μm, was attached with a silicone-based adhesive. Thus, a contacting member 1 having a fluororesin fiber layer was prepared. The thickness of the fluororesin fiber layer was adjusted before the fluororesin fiber layer was attached to the substrate. The thickness of the fluororesin fiber layer was adjusted by sandwiching the fluororesin fiber at a linear pressure of 17 kg/cm and calendering it at a speed of 1 m/min using a high-speed calendering device (manufactured by YURI ROLL Co., Ltd.).

Average Deformation Amount of Fluororesin Fiber Layer

The average deformation amount of the fluororesin fiber layer was measured by a compact table-top tester EZ-SX (manufactured by Shimadzu Corporation). A circular indenter having a diameter 5 mm was attached to the tip of the tester, then the above-prepared contacting member was set to the tester, and the circular indenter was brought into contact with the fluororesin fiber layer of the contacting member. The load at the initial contact was set to 0 N, and the displacement amount when the indenter was pushed at a speed of 0.02 mm/sec until a stress of 0.5 N was generated was defined as a displacement amount 1. In addition, the displacement amount when the indenter was pushed until a stress of 3.3 N was generated was defined as a displacement amount 2. Based on the displacement amount 1 and the displacement amount 2, the deformation amount was calculated from the following equation (1). The deformation amount was determined in this way at 10 different measurement positions, and the average value thereof was defined as the average deformation amount of the fluororesin fiber layer. The results are presented in Table 1.

$$\text{Deformation Amount } (\mu m/N) = (\text{Displacement Amount 2} - \text{Displacement Amount 1})/2.8 \quad \text{Equation (1)}$$

Thickness of Fluororesin Fiber Layer

The thickness of the fluororesin fiber layer was measured using a Digimatic Micrometer MDC-25MX (manufactured by Mitutoyo Corporation). The results are presented in Table 1.

Air Permeability of Fluororesin Fiber Layer

The air permeability of the fluororesin fiber layer was measured by a Gurley automatic air permeability meter (manufactured by Emo) according to a method based on ISO5636. Specifically, first, the fluororesin fiber layer was separated from the substrate by dissolving the adhesive components in the fluororesin fiber layer in toluene (Wako special grade). Next, the time required for 300 ml of air to pass through the separated fluororesin fiber layer with respect to a passage diameter of 10 mm was measured. The measurement was performed at 10 different positions, and the average value was defined as the air permeability. The results are presented in Table 1.

Printing by Printing Apparatus Incorporating Contacting Member

An inkjet printing system (RICOH Pro VC60000, manufactured by Ricoh Co., Ltd.) was modified to incorporate the above-prepared contacting member, and an image was printed on a recording medium serving as a contacted member. The contacting member was incorporated in a position that is downstream of the drying device that dries the applied liquid composition 1 (ink) and liquid composition 2 (aftertreatment liquid) in the conveyance direction of the contacted member in the conveyance path in the printing apparatus, which first comes into direct contact with the region to which the liquid composition 1 (ink) and the liquid composition 2 (aftertreatment liquid) had been applied. As the recording medium, a rolled sheet LUMI ART GLOSS 130 gsm (manufactured by Stora Enso, having a sheet width of 520.7 mm) and another rolled sheet obtained by cutting this rolled sheet so that the sheet width became ¼ were used. In the first step, the rolled sheet with the ¼ sheet width was set in the modified machine and conveyed for 12 km at a speed of 50 m/min. In the second step, a solid image was printed with the liquid composition 1 (ink) on the uncut rolled sheet at a resolution of 1,200 dpi, and another solid image was immediately thereafter printed with the liquid composition 2 (aftertreatment liquid) on the liquid composition 1 (ink). At the time of printing in the second step, the solid image formed by the liquid composition 1 (ink) and the liquid composition 2 (aftertreatment liquid) was conveyed in contact with the boundary on the contacting member between a region to which the rolled sheet had been conveyed in the first step and another position to which the rolled sheet had not been conveyed.

Examples 2 to 17 and Comparative Examples 1 to 4

In each of Examples 2 to 17 and Comparative Examples 1 to 4, the procedures in Example 1 were repeated except for changing the type of the fluororesin fiber, the linear pressure in the calendering process, the diameter of the hollow roller as the substrate, and the winding ratio of the recording medium with respect to the contacting member incorporated in the printing apparatus according to Table 1. The results of the average deformation amount of the fluororesin fiber layer, the thickness of the fluororesin fiber layer, and the air permeability of the fluororesin fiber layer are presented in Table 1.

The product names and manufacturers of the fibers described in Table 1 are as follows.

TOMY FILEC PA5LH (fluororesin fiber, manufactured by TOMOEGAWA CO., LTD.)

TOMY FILEC PA10LH (fluororesin fiber, manufactured by TOMOEGAWA CO., LTD.)

TOYOFLON 406D (fluororesin fiber, manufactured by Toray Industries, Inc.)

TOYOFLON 2402 (fluororesin fiber, manufactured by Toray Industries, Inc.)

TOYOFLON FP002CD (fluororesin fiber, manufactured by Toray Industries, Inc.)

TOYOFLON T33R (fluororesin fiber, manufactured by Toray Industries, Inc.)

CHUKOH FLO™ G-type Fabric FGF-300 (fluororesin-coated glass fiber, manufactured by Chukoh Chemical Industries, Ltd.)

Image Detachability

In the above Examples and Comparative Examples, solid image detachability was evaluated. Specifically, the solid image portion formed by the operations described in "Printing by Printing Apparatus incorporating Contacting Member" above was visually observed from a distance of 300 mm. More specifically, a 25 mm square area was arbitrarily specified in the solid image portion that had passed through the boundary on the contacting member between the region where the rolled sheet had been conveyed in the first step and the region where the rolled sheet had not been conveyed, and the number of points where the solid image was detached off within the specified area was counted. Image detachability was evaluated based on the following evaluation criteria. The results are presented in Table 1. The ranks A, B, and C are evaluated as being practically usable.

Evaluation Criteria

A: The number of points where image detachment occurred is 2 or less.

B: The number of points where image detachment occurred is from 3 to 5.

C: The number of points where image detachment occurred is from 6 to 10.

D: The number of points where image detachment occurred is 11 or more.

TABLE 1

| | | | | | | | | Image Detachability | |
|---|---|---|---|---|---|---|---|---|---|
| | | | Average | | Air | Roller | | Number of | |
| | Type of Fluororesin Fiber | Linear Pressure (kg/cm) | Deformation Amount (μm/N) | Thickness (μm) | Perme-ability (sec) | Diameter (mm) | Winding Ratio (%) | Image Detach-ments | Rank |
| Ex. 1 | TOMY FILEC PA5LH | 17.0 | 11.88 | 320 | 9 | 75 | 50 | 5 | B |
| Ex. 2 | TOMY FILEC PA5LH | 87.0 | 8.39 | 290 | 15 | 75 | 50 | 6 | C |
| Ex. 3 | TOMY FILEC PA10LH | 17.0 | 17.74 | 630 | 14 | 75 | 50 | 3 | B |
| Ex. 4 | TOMY FILEC PA10LH | 87.0 | 11.38 | 370 | 20 | 75 | 50 | 3 | B |
| Ex. 5 | TOMY FILEC PA10LH | 139.0 | 10.13 | 310 | 22 | 75 | 50 | 3 | B |
| Ex. 6 | TOMY FILEC PA10LH | 17.0 | 17.74 | 630 | 14 | 75 | 25 | 1 | A |
| Ex. 7 | TOMY FILEC PA10LH | 17.0 | 17.74 | 630 | 14 | 75 | 90 | 2 | A |
| Ex. 8 | TOMY FILEC PA10LH | 17.0 | 17.74 | 630 | 14 | 75 | 40 | 1 | A |
| Ex. 9 | TOMY FILEC PA10LH | 17.0 | 17.74 | 630 | 14 | 75 | 80 | 2 | A |
| Ex. 10 | TOMY FILEC PA10LH | 17.0 | 17.74 | 630 | 14 | 50 | 50 | 0 | A |
| Ex. 11 | TOMY FILEC PA10LH | 17.0 | 17.74 | 630 | 14 | 60 | 50 | 0 | A |
| Ex. 12 | TOMY FILEC PA10LH | 17.0 | 17.74 | 630 | 14 | 90 | 50 | 0 | A |
| Ex. 13 | TOMY FILEC PA10LH | 17.0 | 17.74 | 630 | 14 | 100 | 50 | 0 | A |
| Ex. 14 | TOYOFLON 406D | 17.0 | 9.51 | 320 | 3 | 75 | 50 | 8 | C |
| Ex. 15 | TOYOFLON 2402 | 17.0 | 7.10 | 250 | 3 | 75 | 50 | 9 | C |
| Ex. 16 | TOYOFLON FP002CD | 17.0 | 5.36 | 800 | 3 | 75 | 50 | 9 | C |
| Ex. 17 | TOYOFLON T33R | 17.0 | 8.93 | 700 | 3 | 75 | 50 | 6 | C |
| Comp. Ex. 1 | TOMY FILEC PA5LH | 0.0 | 23.84 | 500 | 8 | 75 | 50 | 12 | D |
| Comp. Ex. 2 | TOMY FILEC PA10LH | 0.0 | 19.02 | 900 | 12 | 75 | 50 | 12 | D |
| Comp. Ex. 3 | CHUKOH FLO ™ FGF-300 | 0.0 | 7.68 | 500 | >100 | 75 | 50 | 20 | D |

TABLE 1-continued

| | Type of Fluororesin Fiber | Linear Pressure (kg/cm) | Average Deformation Amount (μm/N) | Thickness (μm) | Air Permeability (sec) | Roller Diameter (mm) | Roller Winding Ratio (%) | Image Detachability Number of Image Detachments | Image Detachability Rank |
|---|---|---|---|---|---|---|---|---|---|
| Comp. Ex. 4 | CHUKOH FLO ™ FGF-300 | 17.0 | 4.20 | 450 | >100 | 75 | 50 | 20 | D |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A contacting member that contacts a region of a contacted member to which a liquid composition has been applied, comprising:

a fluororesin fiber layer containing a fluororesin fiber, the fluororesin fiber layer disposed on a surface of the contacting member which contacts the contacted member, wherein the fluororesin fiber layer has an average deformation amount of from 5.0 to 18.0 μm/N, determined by:

attaching a circular indenter having a diameter of 5 mm to a compact table-top tester;

bringing the circular indenter into contact with the fluororesin fiber layer;

setting a load at an initial contact of the circular indenter with the fluororesin fiber layer to 0 N;

pushing the circular indenter at a speed of 0.02 mm/sec until a stress of 0.5 N is generated to measure a displacement amount 1;

pushing the circular indenter until a stress of 3.3 N is generated to measure a displacement amount 2; and calculating the deformation amount from the following equation:

Deformation Amount (μm/N)=(Displacement Amount 2−Displacement Amount 1)/2.8.

2. The contacting member according to claim 1, wherein the average deformation amount is from 8.0 to 12.0 μm/N.

3. The contacting member according to claim 1, wherein the fluororesin fiber layer has a thickness of from 300 to 700 μm.

4. The contacting member according to claim 1, wherein the fluororesin fiber layer has an air permeability of from 4 to 16 seconds.

5. The contacting member according to claim 1, further comprising:

a substrate in a roller shape having a diameter of from 50 to 100 mm, wherein the fluororesin fiber layer is directly or indirectly fixed to the substrate.

6. The contacting member according to claim 5, wherein a winding ratio of the contacted member with respect to the contacting member is 10% or more.

7. A drying device that dries a contacted member to which a liquid composition has been applied, comprising:

the contacting member according to claim 1.

8. The drying device according to claim 7, further comprising:

a liquid composition heater configured to heat the liquid composition applied to the contacted member from a back side of a surface of the contacted member having the region, wherein the contacting member contacts the region of the contacted member heated by the liquid composition heater.

9. A printing apparatus comprising:

the drying device according to claim 7.

10. The contacting member according to claim 1, wherein the fluororesin fiber layer is disposed on a surface of the contacting member which contacts a recording medium, as the contacted member.

11. The contacting member according to claim 10, wherein the recording medium is at least one recording medium selected from the group consisting of plain paper, gloss paper, special paper, and cloth.

12. The contacting member according to claim 1, wherein the fluororesin fiber layer is disposed on a surface of the contacting member which contacts an image formed with the liquid composition on the contacted member.

13. The contacting member according to claim 1, wherein the liquid composition comprises an ink.

14. A contacting member that contacts a region of a contacted member to which a liquid composition has been applied, comprising:

a fluororesin fiber layer containing a fluororesin fiber, the fluororesin fiber layer disposed on a surface of the contacting member which contacts the contacted member, wherein the fluororesin fiber layer has a thickness of from 300 to 700 μm, and wherein the fluororesin fiber layer has an average deformation amount of from 8.0 to 12.0 μm/N, determined by:

attaching a circular indenter having a diameter of 5 mm to a compact table-top tester;

bringing the circular indenter into contact with the fluororesin fiber layer;

setting a load at an initial contact of the circular indenter with the fluororesin fiber layer to 0 N;

pushing the circular indenter at a speed of 0.02 mm/sec until a stress of 0.5 N is generated to measure a displacement amount 1;

pushing the circular indenter until a stress of 3.3 N is generated to measure a displacement amount 2; and calculating the deformation amount from the following equation:

Deformation Amount (μm/N)=(Displacement Amount 2−Displacement Amount 1)/2.8.

* * * * *